US007631777B1

(12) United States Patent
Bukowski

(10) Patent No.: US 7,631,777 B1
(45) Date of Patent: Dec. 15, 2009

(54) CAN AND BOTTLE COVERS

(76) Inventor: Bryan A. Bukowski, 11392 Bridget La., Hales Comers, WI (US) 53130

( * ) Notice: Subject to any disclaimer, the term of this patent is extended or adjusted under 35 U.S.C. 154(b) by 0 days.

(21) Appl. No.: 11/852,559

(22) Filed: Sep. 10, 2007

(51) Int. Cl.
*B65D 17/36* (2006.01)
*B65D 51/20* (2006.01)

(52) U.S. Cl. ..... 220/270; 81/3.55; 220/212; 220/258.1; 220/274; 220/906; D8/33; D8/40

(58) Field of Classification Search ..... 220/270, 220/212, 274, 906, 254.4, 258.1; D8/33, D8/40; 215/306; 81/355
See application file for complete search history.

(56) References Cited

U.S. PATENT DOCUMENTS 578,920 A * 3/1897 Gulden ..... 215/235
615,322 A * 12/1898 Tatum ..... 215/245
1,474,105 A * 11/1923 Camp et al. ..... 215/299
2,857,069 A * 10/1958 Stevens ..... 215/306
3,851,783 A * 12/1974 Braginetz ..... 215/232
D269,587 S * 7/1983 Hanslmair ..... D8/40
4,412,464 A * 11/1983 Cook ..... 81/3.09
4,416,171 A * 11/1983 Chmela et al. ..... 81/3.55
4,463,866 A * 8/1984 Mandel ..... 220/269
4,660,446 A * 4/1987 Soltis ..... 81/3.55
4,681,358 A * 7/1987 Smith ..... 294/15
4,917,258 A * 4/1990 Boyd et al. ..... 220/240
D346,939 S * 5/1994 Wardle ..... D8/40
5,497,896 A * 3/1996 Shand ..... 220/269
5,911,794 A * 6/1999 Nordhoff ..... 81/3.55
6,460,719 B1 * 10/2002 Finmark ..... 220/258.5
6,648,158 B1 * 11/2003 Lawrence ..... 215/306
7,089,825 B2 * 8/2006 Klosterman ..... 81/3.55
2005/0284263 A1 * 12/2005 Klosterman ..... 81/3.55

* cited by examiner

*Primary Examiner*—Anthony Stashick
*Assistant Examiner*—Niki M Eloshway
(74) *Attorney, Agent, or Firm*—Donald J. Ersler

(57) ABSTRACT

Can and bottle covers include a can cover and a bottle cover. The can cover includes a cover portion, a rim portion and a tab portion. One end of the cover portion is inserted under a pull tab of a pop top can. The rim portion connects the other end of the cover portion with one end of the tab portion. The tab portion is inserted, under the pull tab to open the pop top can. The bottle cover includes a cover portion, a neck portion and a web portion. A slot is formed in one end of the neck portion. The slot is sized to be received by a neck end of a bottle. The web portion connects the cover portion with the neck portion. A neck projection is preferably formed in the cover portion. The neck projection is retained in an inner perimeter of the neck end.

10 Claims, 7 Drawing Sheets

CAN AND BOTTLE COVERS

BACKGROUND OF THE INVENTION

1. Field of the Invention

The present invention relates generally to covering beverage containers and more specifically to can and bottle covers, which are placed over a can or a bottle to protect thereof from insects.

2. Discussion of the Prior Art

Insects, such as bees are attracted to open containers of soda and beer. No one wants to drink a can or bottle with a live bee residing inside the container. There are numerous covers for cans and bottles in the art. However, it appears that none of the prior art can and bottle covers may be carried on a key chain.

Accordingly, there is a clearly felt need in the art for a can cover, which is placed over a can to protect thereof from insects and a bottle cover, which is placed over a bottle to protect thereof from insects.

SUMMARY OF THE INVENTION

The present invention provides can and bottle covers, which are placed over cans and bottles to protect thereof from insects. The can cover includes a cover portion, a rim portion and a tab portion. A slot is preferably formed in one end of the cover portion. The slot is sized to be inserted, under a pull tab of a pop top can. The other end of the cover portion is terminated with a bottom of the rim portion. The rim portion includes a shape, which is sized to be received by an inner perimeter of a can rim of the pop top can. The rim portion also preferably extends from the other end of the cover portion at an angle. One end of the tab portion is terminated with a top of the rim portion. The other end of the tab portion is preferably terminated with a substantially curved end. A hole may be formed through the tab portion for retention by a key ring. A top of the can cover is preferably textured and a bottom of the can cover is preferably smooth. The tab portion may be inserted, under the pull tab to lift thereof to open the pop top can.

A bottle cover includes a cover portion, a neck portion and a web portion. A slot is formed in one end of the neck portion. The slot is sized to be received by an outer perimeter of a neck end of a bottle. One end of the web portion extends from the other end of the neck portion. One end of the cover portion extends from the other end of the web portion. The web portion connects the cover portion with the neck portion. A neck projection is preferably formed in substantially the other end of the cover portion. The neck projection retains the cover portion in an inner perimeter of the neck end of an uncapped bottle. The bottle cover is preferably fabricated of a plastic material having memory. A hole may be formed through the cover portion for retention by a key ring.

Accordingly, it is an object of the present invention to provide a can cover, which is placed over a pop top can to protect thereof from insect intrusion and which may be used to pry an opener tab for opening the pop top can.

Finally, it is another object of the present invention to provide a bottle cover, which is placed over a bottle to protect thereof from insect intrusion.

These and additional objects, advantages, features and benefits of the present invention will become apparent from the following specification.

DETAILED DESCRIPTION OF THE PREFERRED EMBODIMENTS

Figure 1:
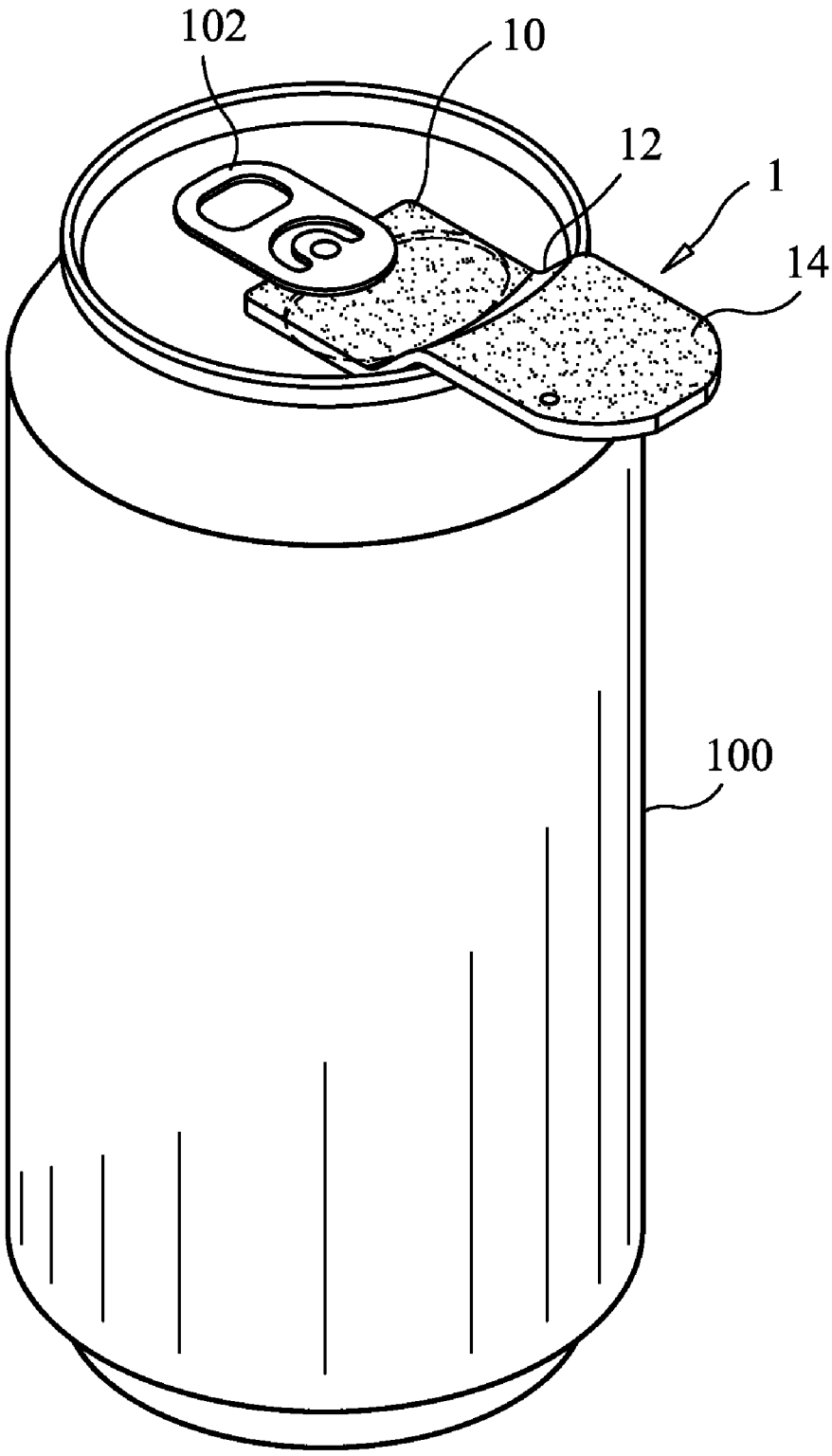
FIG. 1 is a perspective view of a can cover covering an opening in a top of a pop top can in accordance with the present invention.

With reference now to the drawings, and particularly to FIG. 1, there is shown a perspective view of a can cover 1 covering an opening 104 in a pop top can 100. With reference to FIGS. 3-6, the can cover 1 includes a cover portion 10, a rim portion 12 and a tab portion 14. A slot 16 is preferably formed in one end of the cover portion 10. The slot 16 is sized to be inserted, under a pull tab 102 of the pop top can 100, such as a soda or beer can. The slot 16 preferably has a substantially semi-circular shape. The other end of the cover portion 10 is terminated with a bottom of the rim portion 12. The cover portion 10 at least covers substantially all of the beverage opening 104 in the pop top can 100.

Figure 2:
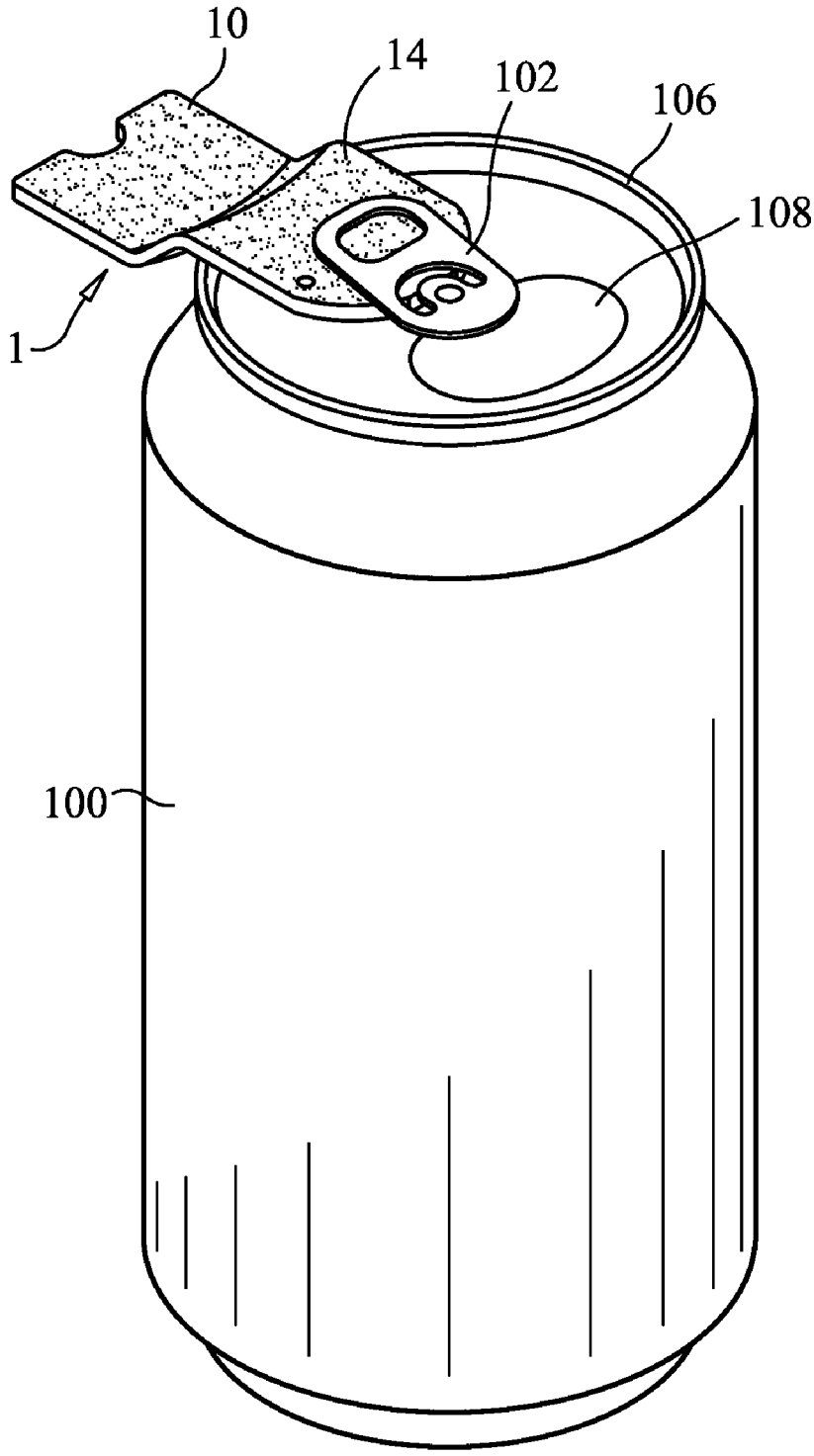
FIG. 2 is a perspective view of a can cover oriented to lift a pull tab of a pop top can in accordance with the present invention.
Figure 3:
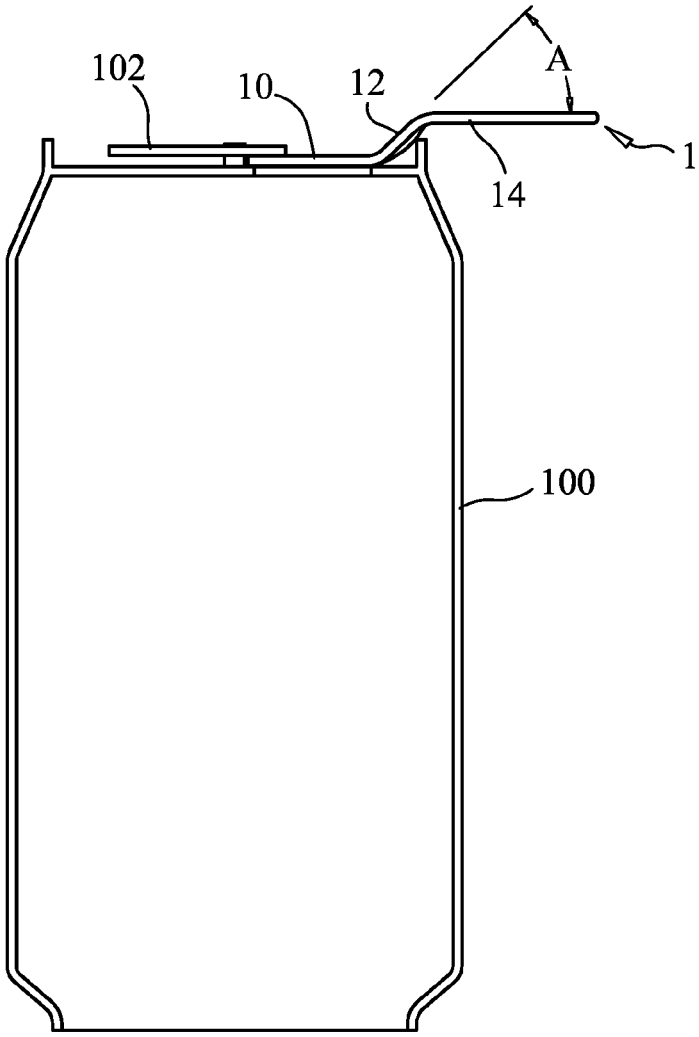
FIG. 3 is a cross sectional view of a can cover covering an opening in a top of a pop top can in accordance with the present invention.
Figure 4:
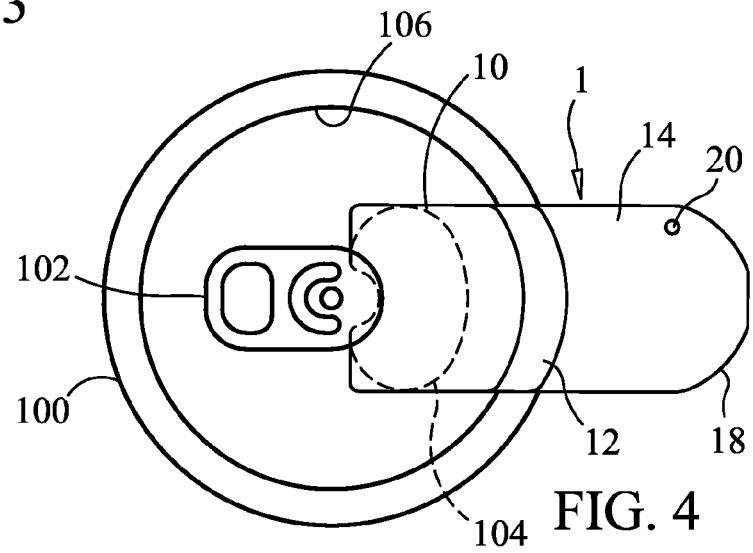
FIG. 4 is a top view of a can cover covering an opening in a top of a pop top can in accordance with the present invention.
Figure 5:
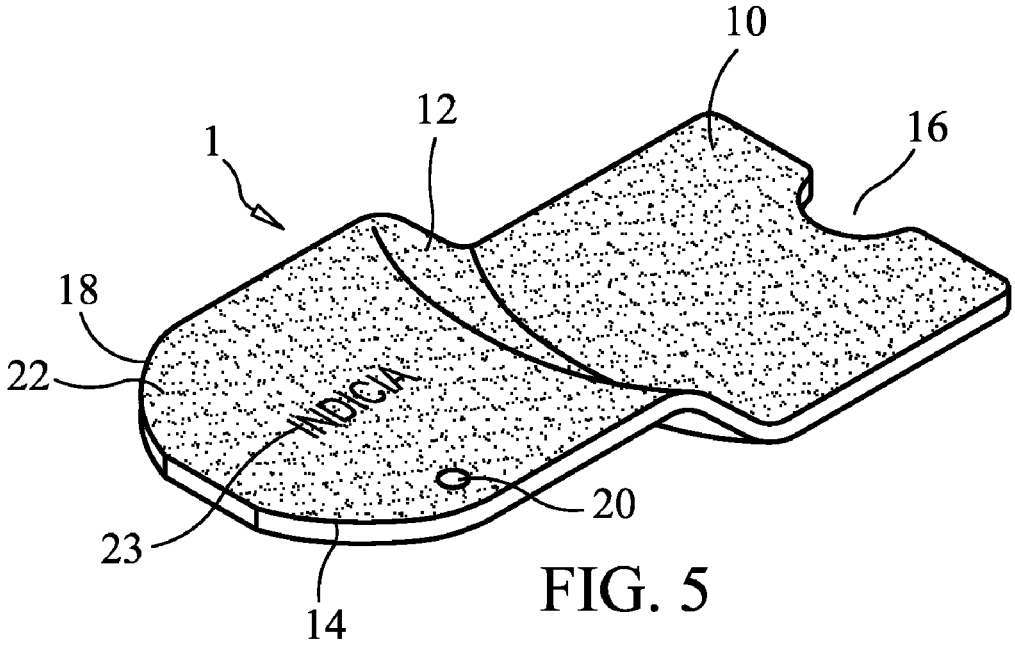
FIG. 5 is a top perspective view of a can cover in accordance with the present invention.
Figure 6:
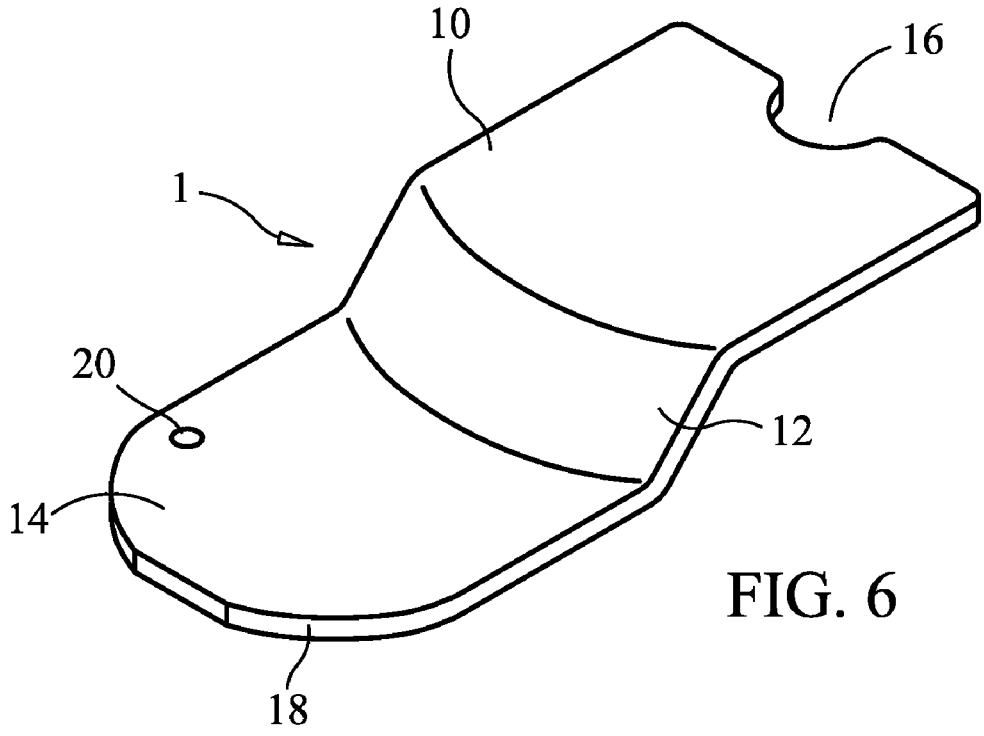
FIG. 6 is a bottom perspective view of a can cover in accordance with the present invention.
Figure 7:
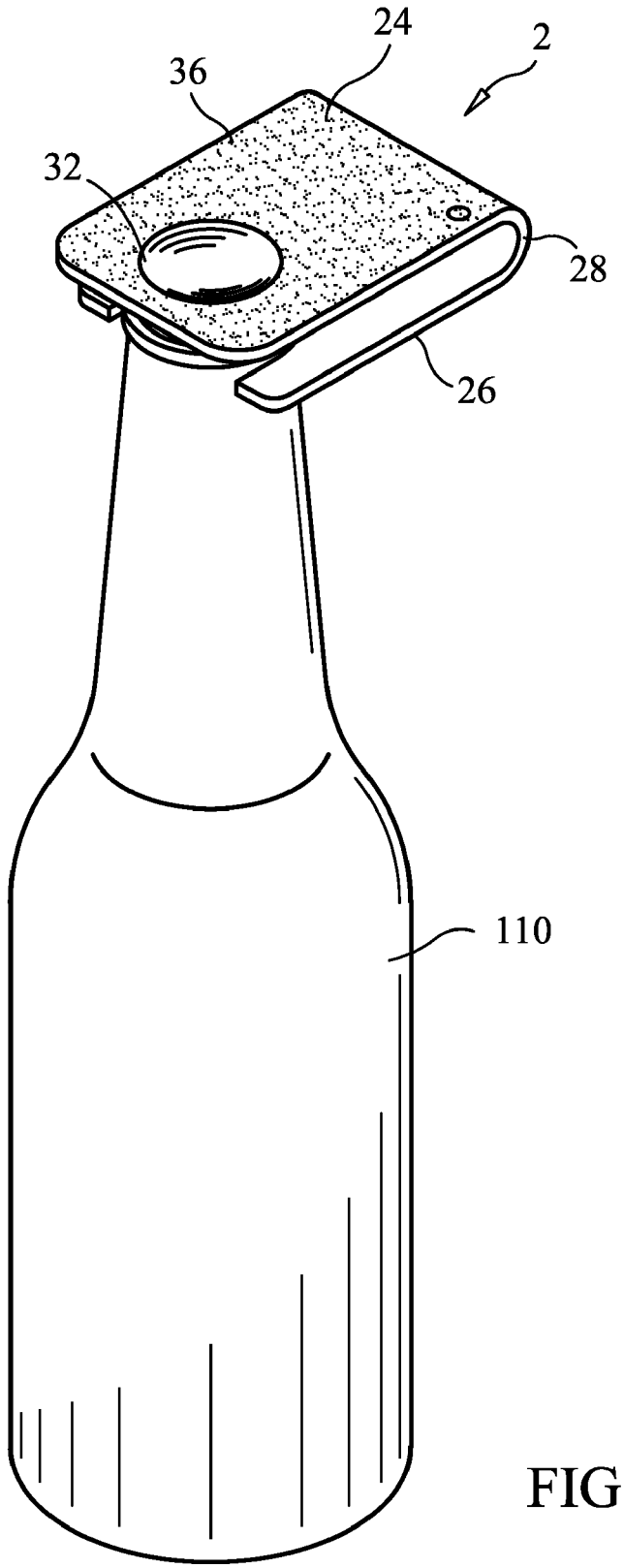
FIG. 7 is a perspective view of a bottle cover covering an opening in a neck end of an uncapped bottle in accordance with the present invention.
Figure 8:
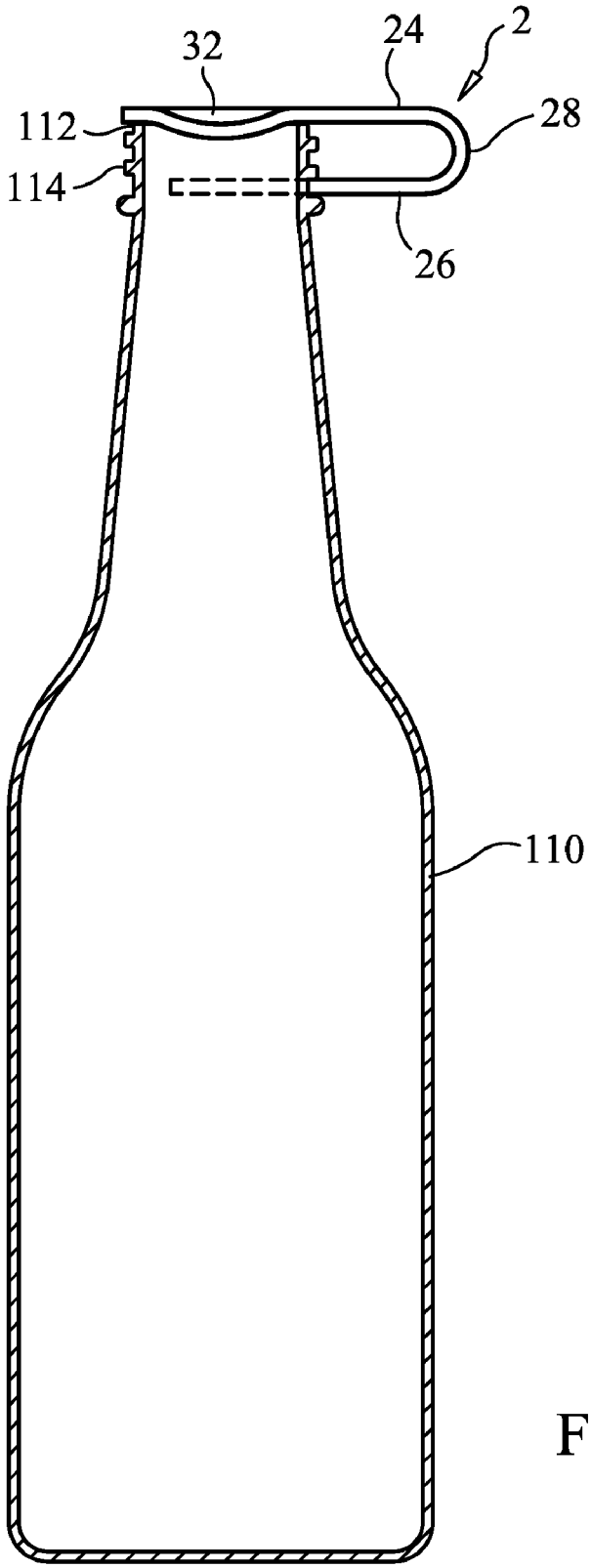
FIG. 8 is a side cross sectional view of a bottle cover covering an opening in a neck end of an uncapped bottle in accordance with the present invention.
Figure 9:
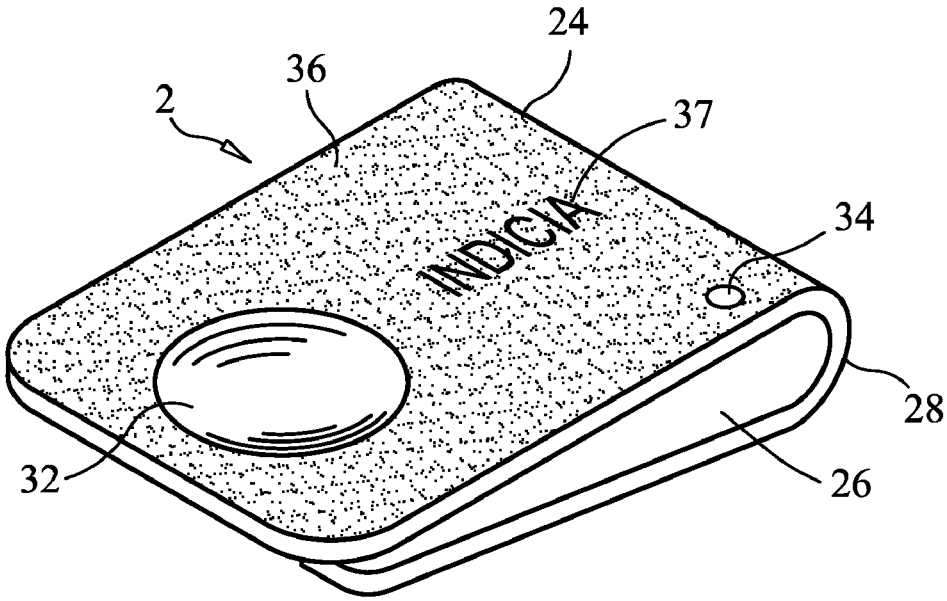
FIG. 9 is a top perspective view of a bottle cover in accordance with the present invention.
Figure 10:
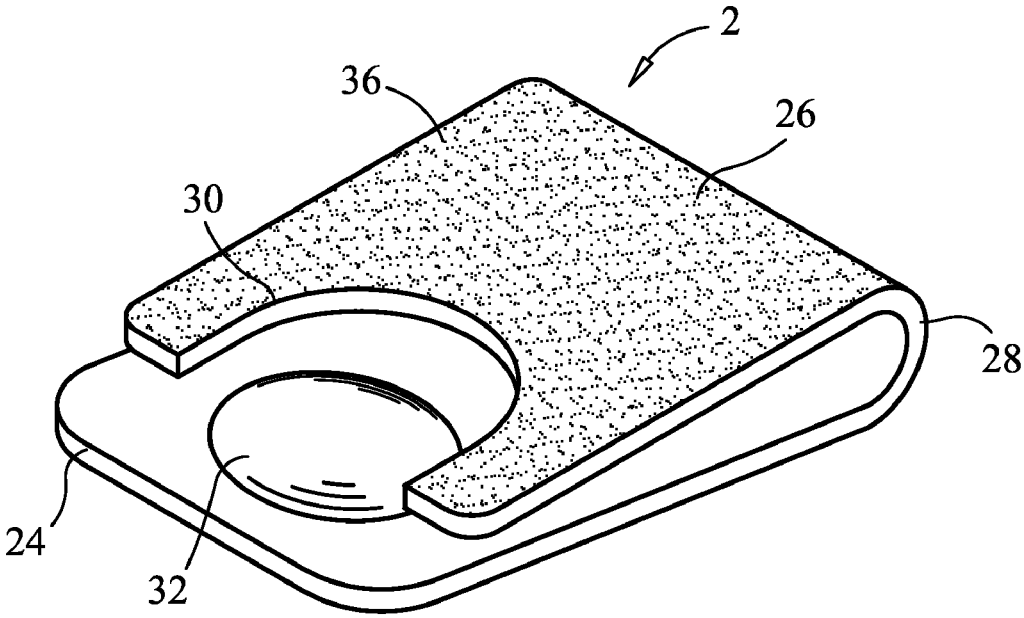
FIG. 10 is a bottom perspective view of a bottle cover in accordance with the present invention.

The rim portion 12 includes a shape, which is sized to be received by an inner perimeter of a can rim 106 of the pop top can 100. The shape of the rim portion 12 is preferably curved, but may have any other appropriate shape. The rim portion 12 preferably extends from the other end of the cover portion 10 at an acute angle "A." A height of the rim portion 12 is preferably greater than a height of the can rim 106. One end of the tab portion 14 is terminated with a top of the rim portion 12. The other end of the tab portion 14 is preferably terminated with a substantially curved end 18. A hole 20 may be formed through the tab portion 14 for retention by a key ring (not shown). A top of the can cover 1 preferably includes a textured surface 22 and a bottom of the can cover 1 is preferably smooth. With reference to FIG. 2, the tab portion 14 may be inserted, under the pull tab 102 to force open a cover slug 108 in a top of the pop top can 100.

The can cover 1 may be fabricated from plastic, vinyl, rubber, metal or any other appropriate material. The can cover 1 may be include any color or combination of colors. A logo, name, advertising, or other indicia 23 may also be applied to the can cover 1.

With reference to FIGS. 7-10, a bottle cover 2 includes a cover portion 24, a neck portion 26 and a web portion 28. A slot 30 is formed in one end of the neck portion 26 to be received by an out perimeter of a neck end 112 of a bottle 110. The neck portion 26 is preferably inserted under the threads 114 on the neck end 112. The slot 30 preferably has a substantially semi-circular shape. One end of the web portion 28 extends from the other end of the neck portion 26. One end of the cover portion 24 extends from the other end of the web portion 28. The web portion 28 connects the cover portion 24 with the neck portion 26.

A neck projection 32 is preferably formed in substantially the other end of the cover portion 24. The neck projection 32 retains the cover portion 24 in an inner perimeter of the neck end 112 of an uncapped bottle 110. The bottle cover 2 is preferably fabricated of a material, such as plastic, vinyl, rubber or metal having memory, such that the one end of the cover portion 24 nearly contacts the other end of the neck portion 26. A hole 34 may be formed through the cover portion 24 for retention by a key ring (not shown). An outside surface of the bottle cover 2 preferably includes a textured surface 36 and an inside surface of the bottle cover 2 is preferably smooth. The bottle cover 2 may be include any color or combination of colors. A logo, name, advertising or other indicia 37 may also be applied to the bottle cover 2.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A can cover for a pop top can, comprising:

a cover portion having a first end and a second end, said first end being insertable under a pull tab of the pop top can, said cover portion at least substantially covering an opening in the pop top can, a slot is formed through a first end of said cover portion, said slot is sized to allow insertion of said first end of said cover portion under the pull tab and past a post of the pull tab;

a rim portion having a circumferential curvature which substantially conforms to a circumferential inner perimeter of a can rim of the pop top can, a height of said rim portion being greater than a height of the can rim, said rim portion including a first end and a second end, said first end of said rim portion extending angularly upward from said second end of said cover portion;

a tab portion having a first end and a second end, said first end of said tab portion angularly extending from a second end of said rim portion.

2. The can cover for a pop top can of claim 1, wherein:

a height of said rim portion being greater than a height of the can rim.

3. The can cover for a pop top can of claim 1, wherein:

a textured surface being formed on a top of said can cover.

4. The can cover for a pop top can of claim 1, wherein:

a smooth surface being formed on a bottom of said can cover.

5. The can cover for a pop top can of claim 1, wherein:

a hole being formed through said tab portion to receive a key ring.

6. The can cover for a pop top can of claim 1, wherein:

indicia being formed on said can cover.

7. A can cover for a pop top can, comprising:

a cover portion having a first end and a second end, said first end being insertable under a pull tab of the pop top can, said cover portion at least substantially covering an opening in the pop top can, a slot is formed through a first end of said cover portion, said slot is sized to allow insertion of said first end of said cover portion under the pull tab and past a post of the pull tab;

a rim portion having a circumferential curvature which is sized to be received by a circumferential inner perimeter of a can rim of the pop top can, a height of said rim portion being greater than a height of the can rim, said rim portion including a first end and a second end, said first end of said rim portion extending angularly upward from said second end of said cover portion; and a tab portion having a first end and a second end, said first end of said tab portion angularly extending from a second end of said rim portion.

8. The can cover for a pop top can of claim 7, wherein:

a textured surface being formed on a top of said can cover.

9. The can cover for a pop top can of claim 7, wherein:

a smooth surface being formed on a bottom of said can cover.

10. The can cover for a pop top can of claim 7, wherein:

a hole being formed through said tab portion to receive a key ring.

* * * * *